United States Patent [19]

Reid

[11] 4,128,692

[45] Dec. 5, 1978

[54] SUPERABSORBENT CELLULOSIC FIBERS HAVING A COATING OF A WATER INSOLUBLE, WATER ABSORBENT POLYMER AND METHOD OF MAKING THE SAME

[75] Inventor: Albert R. Reid, Hockessin, Del.

[73] Assignee: Hercules Incorporated, Wilmington, Del.

[21] Appl. No.: 800,248

[22] Filed: May 25, 1977

Related U.S. Application Data

[63] Continuation-in-part of Ser. No. 501,112, Aug. 27, 1974, abandoned.

[51] Int. Cl.[2] ..... D06M 1/00

[52] U.S. Cl. ..... 428/378; 427/212; 427/337; 427/336; 427/331; 427/342; 427/352

[58] Field of Search ..... 162/146, 157 C, 183; 427/212, 337, 336, 352, 342, 331; 428/393, 394, 395, 378; 128/156, 284, 296; 536/98

[56] References Cited

U.S. PATENT DOCUMENTS

| | | | |
|---|---|---|---|
| 3,122,479 | 2/1964 | Smith | 536/98 |
| 3,379,720 | 4/1968 | Reid | 536/98 |
| 3,589,364 | 6/1971 | Dean et al. | 162/146 |
| 3,686,024 | 8/1972 | Nankee et al. | 128/284 |
| 3,819,470 | 6/1974 | Shaw et al. | 162/157 C |
| 3,890,663 | 9/1976 | Gross | 128/156 |

*Primary Examiner*—S. Leon Bashore
*Assistant Examiner*—William F. Smith
*Attorney, Agent, or Firm*—William S. Alexander

[57] ABSTRACT

Products having high absorbency for use in absorbent dressings and the like are prepared by precipitating a water-insoluble but water-swellable superabsorbent polymer onto the surface of a long fiber cellulose from an aqueous slurry and drying the resulting coated fibers by dehydration with a water-miscible nonsolvent for the polymer.

17 Claims, 2 Drawing Figures

Figure 1:
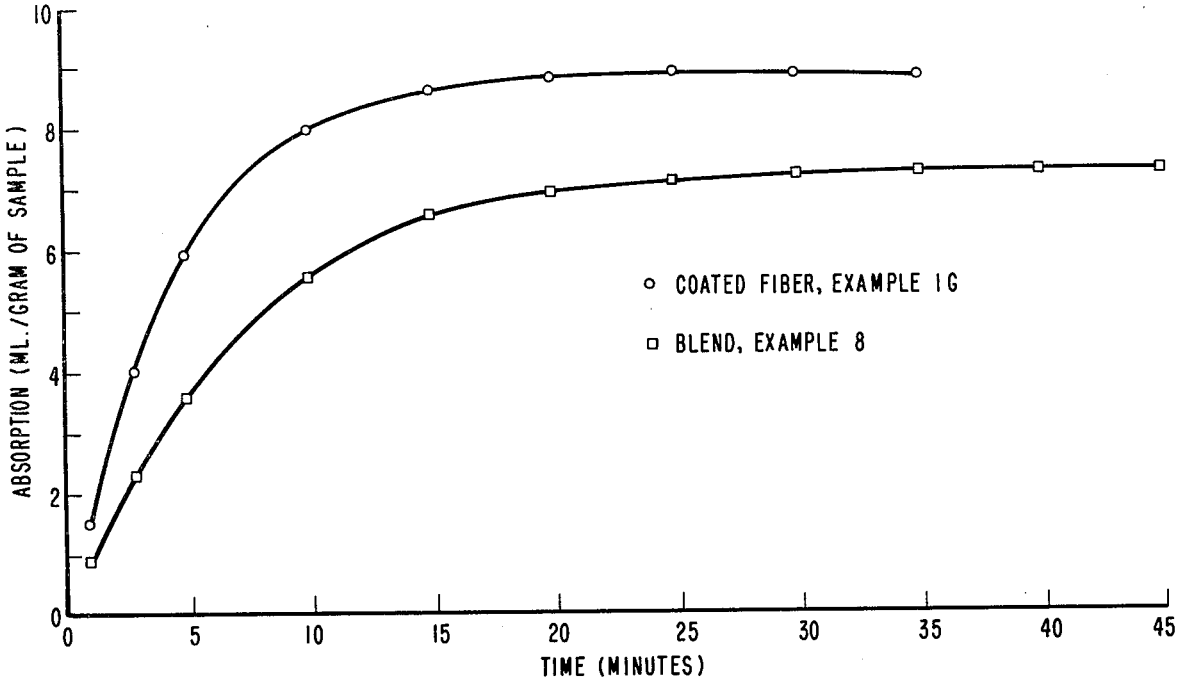

SUPERABSORBENT CELLULOSIC FIBERS HAVING A COATING OF A WATER INSOLUBLE, WATER ABSORBENT POLYMER AND METHOD OF MAKING THE SAME

This application is a continuation-in-part of copending application Ser. No. 501,112, filed Aug. 27, 1974, now abandoned.

This invention relates to materials having a high degree of absorbency for water and aqueous salt solutions. More specifically, it relates to the preparation of such materials based on cellulose in a fibrous form having a coating of a superabsorbent material on its surface.

In recent years, considerable effort has been expended toward finding or developing materials having greater powers of absorbency for water and aqueous salt solutions than the conventional materials hitherto employed for use in absorbent products. Typical of the absorbent products to which reference is made are such things as diapers, bandages, hospital and nursery bed pads and catamenial devices. To date, products of these types have been based primarily on cotton, rayon, wood pulp or materials of this nature.

A number of materials have been found which exhibit substantially better absorbency and retention properties than do those conventionally used in these applications. Generally, these have been polymeric materials which are normally water-soluble but which are treated as, e.g., by cross-linking, to render them substantially water-insoluble but capable of absorbing large amounts of water or aqueous salt solutions. Many of these absorbent materials are cross-linked, water-swellable but water-insoluble, polysaccharide derivatives. Exemplary of these are cross-linked sodium carboxymethyl cellulose, cross-linked partial free acid carboxymethyl cellulose (carboxymethyl cellulose will hereafter be referred to as CMC), cross-linked synthetic polymers such as cross-linked acrylamide—sodium acrylate copolymers and cellulosics, and starches, grafted with vinyl materials such as acrylic acid salts, acrylonitrile, and acrylamide. Materials of this type will be referred to hereinafter as "superabsorbent materials".

While materials of the type described are highly absorbent, they have not been totally successful when used as such in absorbent products. In many cases, their absorbency is so great that they form gels which retard or prevent further absorption of liquid. Most lack sufficient wicking action to perform satisfactorily as absorbents. Moreover, these materials are frequently provided in fine particle form, making it difficult to form stable blends of them with long fiber cellulosic furnishes.

In accordance with this invention, a technique has been found which greatly facilitates the incorporation of superabsorbent polymeric materials into structures in which their superabsorbent properties can be utilized. It has been found that if the superabsorbent material is precipitated from a gel onto the surface of a fibrous cellulose material and dehydrated with a water-miscible nonsolvent, discrete coated cellulose fibers are recovered which exhibit extremely good absorbency properties as to both rate of absorption and to volume of fluid which can be absorbed. The inventive process comprises adding a superabsorbent material of the type described above to an aqueous suspension of a long fiber cellulose furnish while agitating, continuing agitation for a time sufficient to allow substantially all of the superabsorbent material to form an aqueous gel slurry having the long fiber cellulose furnish suspended therein, precipitating the superabsorbent material onto the surface of the long fiber furnish by adding a water-miscible nonsolvent material to said slurry, and dehydrating the coated fibers with a water-miscible nonsolvent.

Figure 2:
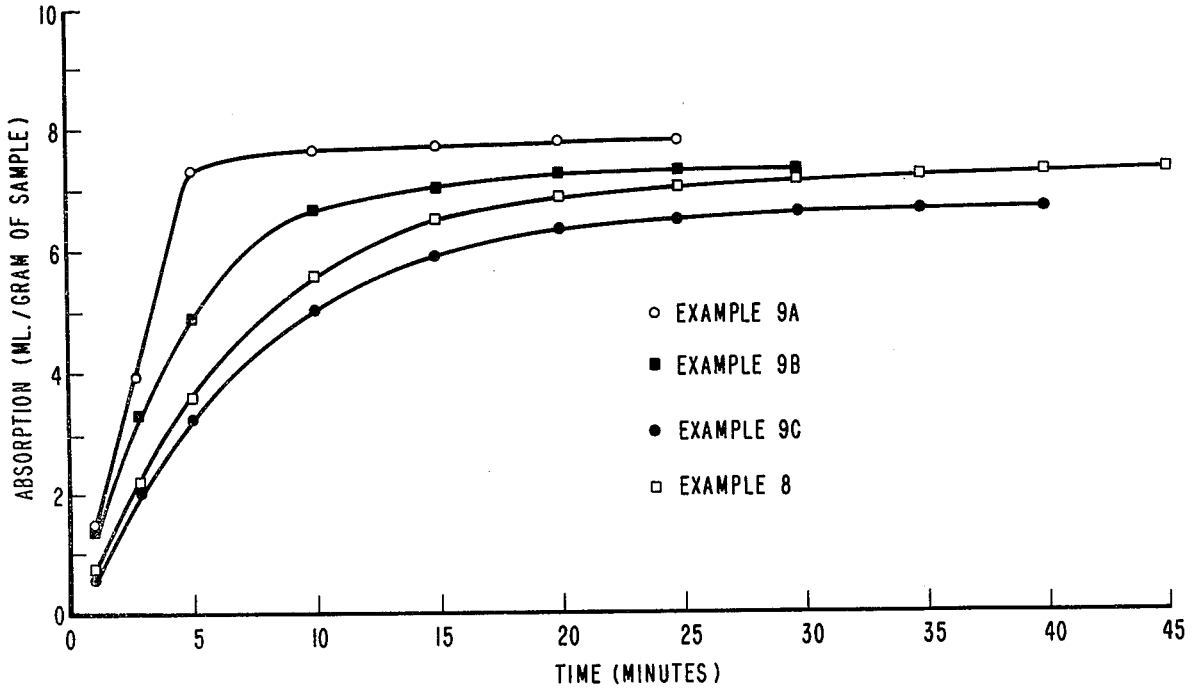

In the attached drawings, FIGS. 1 and 2 are graphical presentations of data showing the absorption properties of some hereinafter exemplified embodiments of the invention, and comparison of products of this invention with physical blends of superabsorbents and long fiber substrates having the same content of superabsorbent.

Applicable superabsorbent materials include any water-insoluble, water-swellable polymers, including synthetic polymers such as cross-linked acrylamide—sodium acrylate copolymers. The superabsorbent materials of choice in this invention are based on polysaccharides, either natural or synthetic. Materials of this class include, e.g., cross-linked, normally water-soluble cellulose derivatives which are cross-linked to water-insoluble, water-swellable compounds, such as cross-linked sodium CMC, and cross-linked hydroxyethyl cellulose, cross-linked partial free acid CMC, and cellulose, starch, and guar gum grafted with acrylamide and acrylic acid salts in combination with divinyl compounds, e.g., methylene-bis acrylamide. The most preferred materials are the CMC derivatives, either cross-linked sodium CMC or partial free acid CMC. Both of these materials are known to the art to be highly absorbent.

Sodium CMC can be cross-linked with any of a number of reagents which are difunctional with respect to cellulose. Cross-linking methods applicable to sodium CMC are discussed in, e.g., U.S. Pat. Nos. 3,168,421 and 3,589,364. Reagents which are difunctional with respect to cellulose include formaldehyde, epichlorohydrin and diepoxide reagents. Epichlorohydrin is a particularly useful cross-linker. Cross-linking can be accomplished by either the wet or dry method taught in the reference patents. Either technique produces a water-insoluble but bibulous, highly absorbent product which can be employed in the practice of this invention.

Partial free acid CMC is also a known material. It is substantially insoluble in water but will absorb and retain large quantities of water. It is prepared from the conventional sodium salt of CMC by acidifying, as by the method described in U.S. Pat. No. 3,379,720. Upon drying, the CMC is believed to cross-link via an internal esterification reaction, leading to the highly absorbent state desired in the instant invention and described in U.S. Pat. No. 3,678,031. The latter reference teaches a method of preparing this product directly without first forming the completely neutralized sodium salt. The product resulting from this process is likewise highly absorbent and suitable for use in the instant invention. When reference is made herinafter to partial free acid CMC, it can be taken to indicate the dried, cross-linked water-insoluble material.

In carrying out the process of this invention, the superabsorbent material and long fiber substrate are added to a quantity of water or aqueous organic medium in excess of that which the superabsorbent material can absorb. Hydration of the superabsorbent occurs to the point where the individual particles swell, forming an aqueous gel slurry. Upon agitation, these superabsorbent particles are dispersed throughout the aqueous suspension of long fiber substrate (e.g., chemical cotton, wood pulp, staple cotton, rayon, plant fibers).

The long fiber cellulose can be chemical cotton, wood pulp, staple cotton, rayon or plant fibers, for example. Usually, such fibers are about 2 to 50 mm. in length. The fibers are discrete, i.e., in fibrous state rather than being incorporated into a fabric or other wet structure.

The superabsorbent can be added before, after or during the addition of a long fiber cellulose furnish. In either case, agitation is continued for a time sufficient to form a homogeneous mixture of discrete cellulose fibers in the gel and to allow the gel to impregnate the fibers. The agitation should be sufficiently strenuous to disperse the particles of gelled superabsorbent while not damaging the long fiber cellulose furnish.

The superabsorbent material is recovered from the gel state and precipitated onto the long fiber cellulose furnish by contacting the gel slurry while continuing agitation with a water-miscible, organic liquid which neither dissolves nor swells either the cellulose furnish or the superabsorbent. Precipitation of the superabsorbent is followed by removal of excess liquid (via centrifuging, vacuum and/or pressure filtration or pressing and decanting). Dehydration with the same water-miscible organic nonsolvent, or by another which meets the same limitations, then follows. Dehydration can be carried out by contacting the product from the precipitation stage with successive lots of water-miscible nonsolvent. The product is then dried to remove the water-miscible organic nonsolvent. Preferred water-miscible nonsolvents are the water-miscible ketones and lower alcohols.

The specified method of water removal is critical. In practice, drying can be accomplished by simply evaporating the water. Drying by this technique is difficult and very timeconsuming, due to the affinity of the superabsorbent material for water. A much more serious problem, however, if drying is accomplished by simple evaporation, is that the gel particles tend to coalesce as the water evaporates, forming a matrix in which the cellulose fibers are fused together rather than being separate and discrete. This matrix is stiff and horny and unsatisfactory as an absorbent material in many applications as it lacks absorbent capacity and rapid rate of absorption.

By contrast, when dehydration is carried out by the method specified herein, water is removed from the superabsorbent without the coalescence and matrix formation described above. Discrete fibers are recovered which are fluffy and soft to the touch. These exhibit excellent water absorbency both as to quantity and rate of absorption. They also exhibit excellent wicking action such that absorbed water can be transmitted throughout a body of the fibers rapidly and relatively uniformly.

The superabsorbent material is added to the long fiber cellulose furnish to add-on levels of about 15 to 90% and preferably from about 40 to 90% based on the weight of the coated long fiber cellulose. However, substantial improvements in absorption properties over the fibrous substrate occur even at superabsorbent add-on levels of 15 to 30% based on the weight of the coated long fiber. On the other hand, above about 90% add-on, the total absorbency and the rate of absorption begin to decline.

In observing the total absorbency and the rate of absorption of the coated long fiber cellulose, it has been noted that the superabsorbent material increases the absorbency of the long fiber cellulose synergistically at add-on levels above about 50%. That is to say, the coated long fiber cellulose will absorb as well or better than will the superabsorbent material alone.

The coated long fiber cellulose of this invention can be used as an absorbent medium alone or in combination with uncoated long fiber cellulose in a ratio such that the total concentration of superabsorbent is between about 15 and 80% to form highly absorbent products for use in, e.g., medical, health care and catamenial products. When used in combination with uncoated long fiber cellulose, the wicking action of the coated fiber affords good total absorbency to a product prepared therewith. In fact, in most cases, the absorbency of a blend of coated and uncoated fibers is greater than that of a physical blend of superabsorbent and uncoated cellulose having an equivalent total content of superabsorbent material. Such a characteristic is of considerable economic importance as it enables one to prepare superior absorbent products with lower concentrations of the more expensive superabsorbent material.

In evaluating the absorbent performance of the products according to this invention, two tests are used principally. These are referred to as the "CAP test" which measures absorbent capacity and initial rate of absorption, and the "Syringe test" which measures absorption rate and wicking ability.

The apparatus employed for the CAP test consists of a Buchner fritted glass funnel, with a rubber tube attached to its neck; the tube is attached at the other end to a 50 ml. burette. The burette is filled with the test solution, and the level of liquid is allowed to rise until it just makes contact with the bottom of the frit in the funnel. The level of liquid in the burette can be anywhere from 0 to 60 cm. below the bottom of this frit. The test sample is placed on top of the frit and a weight exerting a pressure of from 0.1 to 0.4 psi is applied to the sample. The test is then begun, and the loss of fluid in the burette is monitored as a function of time to give the rate of absorption. When equilibrium is reached, the capacity is calculated by dividing the total fluid absorbed at equilibrium, or at the end of 45 minutes, by the weight of the polymer sample. The conditions used with the CAP test for this work were:

(1) Pressure exerted on the sample was 0.11 psi;
(2) All of the tests were done with the liquid in the burette 2 cm. below the fritted glass initially. This level was allowed to continually change as absorption occurred;
(3) Pore size of the frit was about 4–5.5 microns.

In carrying out the Syringe test, a 10 cc. calibrated syringe is filled with 1.0 gram of test sample and compressed with the syringe plunger to give a uniform column of material. The volume to which the material was compressed varied with the bulk of the sample. For most fibrous samples, the compressed volume was 5 ml., but a few very bulky samples could be compressed only to about 8 cm. Granular materials occupied a volume between 1 and 3 cm.

The syringe, without the plunger or a needle, is immersed to the 1 cc. mark in a beaker of dyed blue test solution. The rate of uptake of the test solution is observed, and either the time required for a 5-ml. rise or the volume attained at 30 minutes is recorded.

The invention is illustrated in the examples set forth below. In these examples absorbent properties are demonstrated with a 1% NaCl solution to simulate human body fluids. Other salt solutions or plain water could also be used depending upon the application contemplated for the product.

EXAMPLE 1

1A

In a Waring Blendor jar containing 400 ml. of water was dispersed 1 g. of Grade 85 Chemical Cotton (Hercules Incorporated, Wilmington, Delaware). To this was added 9 g. of partial free acid CMC (made from Grade 85 Chemical Cotton) and stirring was continued for 5 minutes. The slurry was then allowed to stand at room temperature for 10 minutes. After another minute of stirring at low speed, the aqueous slurry was transferred to a 2-liter beaker. To this was added, with agitation, 600 ml. of acetone. The Blendor jar was rinsed with 200 ml. of additional acetone which was also added to the 2-liter beaker. After 10 minutes of low speed stirring in the beaker, excess liquid was removed by alternately pressing and decanting supernatant fluid. The sample was then steeped three times in 600 ml. aliquots of acetone for about 5 minutes each time. Excess acetone was then removed via pressing and decanting and the sample was dried in vacuum at 60° C. for 1.5 hours.

1B

Example 1A was repeated using 8.0 g. of partial free acid CMC and 2.0 g. chemical cotton.

1C

The procedure of Example 1A was repeated except that 3 g. of chemical cotton was used and 7 g. of partial free acid CMC.

1D

Example 1C was repeated except that the water slurry was added to 800 ml. of acetone contained in the 2-liter beaker.

1E

Example 1A was repeated with 4 g. of chemical cotton and 6 g. of cross-linked partial free acid CMC.

1F

The procedure of Example 1A was repeated with 5 g. chemical cotton and 5 g. of partial free acid CMC.

1G

Example 1A was repeated using 6 g. of chemical cotton and 4 g. of partial free acid CMC.

1H

Example 1A was repeated using 7 g. of chemical cotton and 3 g. of partial free acid CMC.

1I

Example 1A was repeated using 8.5 g. of chemical cotton and 1.5 g. of partial free acid CMC.

Each of the above materials was tested for 1% NaCl solution absorbency using the tests described previously. Simultaneous control tests were run employing uncoated chemical cotton and fibrous partial free acid CMC. Pertinent data concerning these materials are recorded in Table I.

TABLE I

| Example No. | % CMC | Absorption/Time Interval* 1 | 3 | 5 | 10 | 15 | 20 | 25 | 30 | 35 | Syringe Test Value** |
|---|---|---|---|---|---|---|---|---|---|---|---|
| | 100 | 1.1 | 2.8 | 4.3 | 7.3 | 9.0 | 9.5 | 9.6 | 9.6 | 9.6 | 14 minutes |
| 1A | 90 | 1.5 | 5.4 | 8.5 | 11.6 | 11.7 | 11.7 | 11.7 | — | — | 4.5 minutes |
| 1B | 80 | 2.0 | 5.3 | 8.1 | 10.3 | 10.6 | 10.6 | 10.6 | — | — | 6 minutes |
| 1C | 70 | 1.9 | 4.7 | 7.2 | 9.8 | 10.1 | 10.2 | 10.2 | 10.2 | — | 8 minutes |
| 1D | 70 | 2.1 | 5.0 | 7.3 | 9.6 | 9.9 | 10.0 | 10.1 | 10.1 | 10.1 | — |
| 1E | 60 | 2.1 | 5.0 | 7.2 | 9.0 | 9.3 | 9.3 | 9.3 | — | — | 3.5 minutes |
| 1F | 50 | 1.5 | 4.0 | 6.1 | 8.4 | 8.9 | 9.1 | 9.1 | 9.1 | — | 5.25 minutes |
| 1G | 40 | 1.5 | 4.0 | 5.9 | 7.9 | 8.5 | 8.7 | 8.7 | 8.7 | 8.7 | 55 seconds |
| 1H | 30 | 1.3 | 3.3 | 4.6 | 6.8 | 7.6 | 7.8 | 7.9 | 7.9 | 7.9 | 40 seconds |
| 1I | 15 | 1.1 | 2.8 | 4.2 | 5.9 | 6.6 | 6.8 | 6.9 | 6.9 | 6.9 | 23 seconds |
| | 0 | 0.8 | 1.9 | 2.8 | 3.7 | 4.3 | 4.5 | 4.5 | 4.5 | — | 12 seconds |

*Absorption of 1% aqueous sodium chloride solution (ml./g. of sample) at various times in minutes
**Time to 5 ml. rise of 1% NaCl solution in the syringe The CAP test data in Table I show that the equilibrium absorption capacity of the coated chemical cotton reaches a maximum at about 90% add-on of partial free acid CMC. Also, coated samples containing between about 60 and 90% partial free acid CMC have absorption capacities equal to or greater than the partial free acid itself. The coated products containing 40 to 90% partial free acid CMC have faster initial rates of absorption than the partial free acid CMC by itself.

Lower Syringe Test values for the coated samples indicate better wicking ability and faster rate of absorption than the partial free acid CMC alone.

EXAMPLE 2

2A

In 400 ml. of water in a Waring Blendor, 6 g. of fluffed wood pulp was slurried along with 4 g. of partial free acid CMC made from shredded chemical cotton sheets. After about 5 minutes agitation, the slurry was poured into 800 ml. of acetone and agitated at high speed with an air-driven agitator. Excess liquid was removed, as described in Example 1, and the slurry was steeped three times in 600 ml. of acetone for about 5–10 minutes each time. After removal of excess acetone as described in Example 1, a sample was dried in vacuum at 60° C. for about 1.5 hours.

2B

Example 2A was repeated using 5 g. of fluffed wood pulp and 5 g. of partial free acid CMC.

2C

Example 2A was repeated using 4 g. of fluffed wood pulp and 6 g. of partial free acid CMC.

2D

Example 2A was repeated using 3 g. of fluffed wood pulp and 7 g. of partial free acid CMC.

2E

Example 2A was repeated using 2 g. of the fluffed wood pulp and 8 g. of the partial free acid CMC.

2F

Example 2A was repeated using 1 gram of the fluffed wood pulp and 9 g. of partial free acid CMC.

These samples were tested for their absorbent characteristics using the CAP test and simultaneously running control specimens of uncoated fluffed wood pulp and the partial free acid CMC used for coating. The results are recorded in Table II.

TABLE II

| Example No. | % CMC | Absorption/Time Interval* 1 | 3 | 5 | 10 | 15 | 20 | 25 | 30 | 35 | 40 | 45 |
|---|---|---|---|---|---|---|---|---|---|---|---|---|
| | 0 | 0.7 | 1.4 | 2.1 | 3.4 | 4.0 | 4.5 | 4.7 | 4.9 | 5.0 | 5.1 | 5.1 |
| 2A | 40 | 2.2 | 5.0 | 6.9 | 8.4 | 8.5 | 8.6 | 8.6 | 8.6 | — | — | — |
| 2B | 50 | 2.1 | 4.8 | 6.9 | 9.4 | 9.7 | 9.8 | 9.8 | 9.8 | — | — | — |
| 2C | 60 | 2.1 | 4.8 | 6.9 | 10.2 | 10.7 | 10.8 | 10.8 | 10.8 | — | — | — |
| 2D | 70 | 1.7 | 4.1 | 6.0 | 9.3 | 10.8 | 11.2 | 11.3 | 11.3 | 11.3 | — | — |
| 2E | 80 | 1.6 | 4.1 | 6.0 | 9.3 | 11.2 | 12.1 | 12.3 | 12.3 | 12.3 | — | — |
| 2F | 90 | 1.7 | 4.0 | 5.7 | 8.9 | 10.9 | 12.3 | 13.0 | 13.4 | 13.6 | 13.6 | 13.6 |
| | 100 | 1.7 | 3.9 | 5.8 | 9.3 | 10.7 | 10.9 | 11.0 | 11.0 | 11.0 | — | — |

*Absorption of 1% NaCl solution (ml./g. of sample) at various times in minutes

The CAP test data in Table II show that the equilibrium absorption capacity of the coated wood pulp reaches a maximum at about 90% add-on of the partial free acid CMC. Coated samples containing between about 60 and 90% partial free acid CMC have absorption capacities equal to or greater than the partial free acid CMC itself. The coated samples containing 40 to 90% partial free acid CMC have initial rates of absorption equal to or faster than the partial free acid CMC itself.

These results are in agreement with the CAP test data for the Example I series where a different cross-linked CMC and fibrous substrate were used.

EXAMPLE 3

3A

To a wide-mouthed 32 oz. plastic bottle was added 400 ml. of water and 3.0 g. of staple cotton (extra long fiber furnish). Then 7 g. partial free acid CMC made from Grade 85 Chemical Cotton was added. The bottle was sealed, placed on rollers and rolled for one hour. The contents were then transferred to a 2-liter beaker and the cotton fibers which had become matted and entangled were pulled apart by hand to give a more uniform slurry in the beaker, following which 600 ml. of acetone was poured into the beaker. The bottle was rinsed with another 200 ml. of acetone which was also added to the beaker. The slurry was stirred by hand with a spatula for about 5 minutes, then allowed to stand at room temperature for 15 minutes. Excess liquid was removed by pressing, following which the sample was dehydrated by steeping with three 600-ml. portions of acetone for 10 minutes each steep. After removal of excess acetone, the sample was dried in vacuum at 60° C. for 1.5 hours. The resultant sample was tested for its absorbency characteristics using the CAP test and 1% sodium chloride solution. A control was run simultaneously using just the uncoated cotton. The control from Example 1 series served as a control for the partial free acid CMC in this case.

3B

Example 3A was repeated using staple rayon instead of staple cotton as the long fiber furnish. A control was run simultaneously using just the uncoated rayon.

Pertinent data are recorded in Table III.

TABLE III

| Example No. | % CMC | Absorption/Time Interval* 1 | 3 | 5 | 10 | 15 | 20 | 25 | 30 | 35 | 40 | 45 | Syringe Test Value** |
|---|---|---|---|---|---|---|---|---|---|---|---|---|---|
| Staple Cotton Control | 0 | 0.5 | 1.0 | 1.4 | 2.3 | 2.6 | 2.9 | 3.1 | 3.3 | 3.4 | 3.5 | 3.6 | 40 seconds |
| 3A | 70 | 1.5 | 4.2 | 6.2 | 8.6 | 9.3 | 9.4 | 9.5 | 9.5 | 9.5 | — | — | 34 seconds |
| Staple Rayon Control | 0 | 0.4 | 0.8 | 1.2 | 1.8 | 2.1 | 2.3 | 2.5 | 2.6 | 2.6 | 2.6 | — | 18 seconds |
| 3B | 70 | 1.2 | 3.2 | 5.1 | 7.7 | 8.4 | 8.5 | 8.5 | 8.5 | — | — | — | 28 seconds |
| Control | 100 | 1.1 | 2.8 | 4.3 | 7.3 | 9.0 | 9.5 | 9.6 | 9.6 | 9.6 | — | — | 14 minutes |

*Absorption of 1% NaCl solution (ml./g. of sample) at various times in minutes
**Time to 5 ml. rise of 1% NaCl solution in syringe The CAP test data show that coated fiber Example 3A containing 70% partial free acid CMC as coating has about the same absorption capacity, but a faster initial rate of absorption than the partial free acid CMC itself. Example 3A also exhibited better wicking action than the partial free acid CMC itself, having a lower Syringe test value of 5 ml. in 34 seconds compared to 5 ml. in 14 minutes for the modified CMC.

The CAP test data show that the rayon staple control has a lower absorption capacity than the staple cotton. This difference is reflected in the lower absorption capacity of Example 3B as compared to Example 3A. The wicking action of Example 3B is comparable to that of Example 3A, however, and thus is superior to the partial free acid CMC itself.

EXAMPLE 4

4A

This example compares aqueous acetone solutions with water as the slurry medium. To a Waring Blendor jar containing 200 g. of water was added 4 g. of Grade 85 Chemical Cotton and 6 g. of partial free acid CMC prepared from fine-cut chemical cotton. The slurry was stirred at slow speed for about 5 minutes, let stand for 10 minutes, stirred for one minute, and then transferred to a 1-liter beaker. Four hundred ml. of acetone was added to precipitate the CMC on the chemical cotton. The slurry was stirred for 10 minutes with an air stirrer. Excess liquid was then removed by suction filtration on a coarse sintered glass filter to about 50% solids content and the wet pad of sample was steeped three times with 60 ml. of acetone each steep. The three steeps were carried out on the glass filter also, allowing each 60 ml. lot of acetone to drain through the wet pad of sample for 5 minutes and on the glass filter also, then suction filtering for about 5 minutes. After excess acetone was removed from the sample following the third steep, the sample was dried in vacuum at 60° C. for 1.5 hours.

4B

Example 4A was repeated except that the slurry medium was 200 g. of 20% acetone in water and 266 ml. of acetone was used in the precipitation step.

4C

Example 4A was repeated using 200 g. of 30% aqueous acetone solution as the slurry medium and 202 ml. of acetone in the precipitation step.

4D

Example 4A was repeated using 200 g. of 40% aqueous acetone solution as the slurry medium and 137 ml. of acetone in the precipitation step.

4E

Example 4A was repeated using 200 g. of 50% aqueous acetone solution as the slurry medium and 72 ml. of acetone in the precipitation step.

Syringe test data are given in Table IVa. CAP test data are recorded in Table IVb.

TABLE IVa

| Example No. | Slurry Medium | Syringe Test Value* |
|---|---|---|
| 4A | Water | 4.2 ml. in 30 minutes |
| 4B | 20% aqueous acetone | 5 ml. in 16 minutes |
| 4C | 30% aqueous acetone | 5 ml. in 6.5 minutes |
| 4D | 40% aqueous acetone | 5 ml. in 7 minutes |
| 4E | 50% aqueous acetone | 5 ml. in 1.25 minutes |

*Rate of climb of 1% NaCl solution in Syringe

TABLE IVb

| Example | Absorption/Time Interval* | | | | | | |
|---|---|---|---|---|---|---|---|
| No. | 1 | 3 | 5 | 10 | 15 | 20 | 25 |
| 4A | 2.0 | 4.9 | 6.9 | 8.6 | 8.8 | 8.8 | 8.8 |
| 4B | 2.3 | 5.4 | 7.2 | 8.3 | 8.4 | 8.4 | 8.4 |
| 4C | 2.3 | 5.0 | 7.7 | 8.4 | 8.6 | 8.6 | 8.6 |
| 4D | 2.5 | 5.7 | 7.4 | 8.0 | 8.1 | 8.1 | 8.1 |
| 4E | 1.8 | 4.4 | 6.3 | 7.6 | 7.7 | 7.8 | 7.8 |

*Absorption of 1% NaCl solution (ml./g. of sample) at various times in minutes

The Syringe test data in Table IVa indicate that coated products prepared with aqueous acetone as the slurry medium have better wicking action than those prepared in water. However, at 40 and 50% aqueous acetone levels, the coated samples have slightly less absorption capacity than the coated sample prepared with water as the slurry medium, as shown in Table IVb.

EXAMPLE 5

5A

To 400 ml. of water in a Waring Blendor jar was added 5 g. of fluffed wood pulp and 5 g. of partial free acid CMC made from shredded chemical cotton sheets. After 5 minutes stirring, the slurry was let stand for 10 minutes, stirred one minute and then the slurry was poured into 1700 ml. of methanol and stirred vigorously with an air-driven agitator. After draining off excess liquid, the slurry was steeped three times in methanol using 600 ml. of methanol for each steep. Steeps were of about 5 to 10 minutes duration. The sample was dried in vacuum at 60° C. for 1.5 hours.

5B

Example 5A was repeated using 800 ml. of isopropanol as precipitant and steeping with 600 ml. of isopropanol 3 times.

These specimens were tested using the CAP test and Syringe test. Pertinent data are recorded in Table V.

TABLE V

| Example No. | % CMC | Precipitation Nonsolvent | Absorption/Time Interval* 1 | 5 | 10 | 15 | 20 | 25 | 30 | 40 | 45 | Syringe Test Value** |
|---|---|---|---|---|---|---|---|---|---|---|---|---|
| 5A | 50 | Methanol | 1.5 | 5.2 | 7.7 | 8.9 | 9.2 | 9.4 | 9.5 | 9.6 | 9.6 | 5 ml. in 2.5 mins. |
| 5B | 50 | Isopropanol | 1.2 | 4.3 | 6.8 | 8.0 | 8.5 | 8.7 | 8.8 | 8.9 | 8.9 | 4.2 ml. in 30 mins. |
| 2B*** | 50 | Acetone | 2.1 | 6.9 | 9.4 | 9.7 | 9.8 | 9.8 | 9.8 | — | — | 5 ml. in 15 mins. |

*Absorption of 1% NaCl solution (ml./g. of sample) at various times in minutes
**Rate of climb of 1% NaCl solution in syringe
***For comparison While both precipitants yielded good products, the isopropanol was preferred over methanol since it required only 800 ml. to accomplish the objective. Acetone is preferred over both methanol and isopropanol, however, as less acetone is required than methanol, and acetone imparts better absorption properties to the coated fiber than does isopropanol.

EXAMPLE 6

To a Waring Blendor jar containing 400 ml. of water was added 6 g. of fluffed wood pulp and 4 g. of a densified powdery CMC prepared from fine cut cellulose and cross-linked with epichlorohydrin according to the procedures taught in Dean et al, U.S. Pat. No. 3,589,364. The slurry was stirred for 5 minutes at low speed in the Blendor, and then let stand for 10 minutes at room temperature. After stirring for one minute, the slurry was poured into 800 ml. of acetone contained in a 2-liter beaker. The mixture was stirred with an air driven stirrer. After about 10 minutes stirring, excess liquid was removed via alternately pressing and decanting, and the sample was dehydrated by steeping in acetone three times (600 ml. of acetone per steep of about 10 minutes duration). Excess acetone was removed by alternately pressing and decanting, and the sample was dried in vacuo at 60° C. The absorbent characteristics of this material were tested according to the CAP test and Syringe test. The results are recorded in Table VI.

TABLE VI

| Example No. | Absorption/Time Interval[1] 1 | 3 | 5 | 10 | 15 | 20 | 25 | 30 | 35 | 40 | 45 | Syringe Test Value[2] |
|---|---|---|---|---|---|---|---|---|---|---|---|---|
| 6 | 1.4 | 3.2 | 4.6 | 7.2 | 8.8 | 9.4 | 9.6 | 9.6 | 9.6 | — | — | 5 ml. in 2 minutes |
| Control** | 1.7 | 3.4 | 4.3 | 5.3 | 5.9 | 6.5 | 6.9 | 7.2 | 7.5 | 7.8 | 8.0 | 0 at 30 minutes |
| Control* | 0.7 | 1.4 | 2.1 | 3.4 | 4.0 | 4.5 | 4.7 | 4.9 | 5.0 | 5.1 | 5.1 | 5 ml. in 12 seconds |

*Uncoated fluffed wood pulp
**Epichlorohydrin cross-linked CMC
[1]Absorption of 1% NaCl solution (ml./g. of sample) at various times in minutes
[2]Rate of climb of 1% NaCl solution in syringe The CAP test and Syringe test data in Table VI show that Example 6, with 40% cross-linked CMC as coating, has a higher absorption capacity and better wicking action than the cross-linked CMC itself.

EXAMPLE 7

7A

Eight grams of Grade 85 Chemical Cotton was slurried in 400 ml. of water contained in a Waring Blendor jar. Two grams of fine-particle, water-insoluble but water-swellable cross-linked grafted cellulose (acrylamide:sodium acrylate grafts cross-linked with methylene-bis-acrylamide) was added. The mixture was stirred at low speed in the Blendor for 5 minutes and then let stand 10 minutes. After another minute of stirring, the slurry was transferred to a 2-liter beaker and 800 ml. of acetone was added with stirring via a Lightning Air Stirring. Stirrer was continued for 10 minutes, after which the slurry was left unstirred for 10 minutes. Excess liquid was then removed by alternately decanting and pressing. The sample was steeped in acetone three times, using 600 ml. of acetone per steep of at least 10 minutes duration. After removal of excess acetone by decanting and pressing, the sample was dried in vacuo at 60° C. for 1.5 hours.

7B

The procedure for Example 7A was repeated, replacing the cross-linked grafted cellulose with 2 g. of similarly cross-linked grafted starch powder and replacing the Grade 85 Chemical Cotton with 8 g. of fluffed wood pulp.

7C

The procedure for Example 7A was repeated, replacing the cross-linked grafted cellulose with 2 g. of similar cross-linked grafted guar gum in fine particle form.

7D

The procedure for Example 7A was repeated, replacing the cross-linked grafted cellulose with 3 g. of water-insoluble, but water-swellable, fine particle acrylamide-sodium acrylate copolymer cross-linked with methylene-bis-acrylamide and using 7 g. of Grade 85 Chemical Cotton. The initial slurry was made up in 500 ml. of water in this case. The slurry became too thick to stir adequately in the Blendor, so the mixture was stirred with a spatula by hand for the required time.

TABLE VII

| Example No. | Absorption/Time Interval[1] 1 | 5 | 10 | 15 | 20 | 25 | 30 | 45 | Syringe Test Value[2] |
|---|---|---|---|---|---|---|---|---|---|
| 7A | 0.9 | 3.5 | 5.4 | 6.1 | 6.4 | 6.5 | 6.5 | — | 5 ml. in 70 seconds |
| *Cross-linked Grafted Cellulose | 0.3 | 0.5 | 0.9 | — | — | — | —[3] | Very low[3] | 0 at 30 minutes |
| *Grade 85 Chemical Cotton | 0.8 | 2.8 | 3.7 | 4.3 | 4.5 | 4.5 | 4.5 | — | 5 ml. in 12 seconds |
| 7B | 0.8 | 2.8 | 4.5 | 5.6 | 6.3 | 6.6 | 6.7 | 6.9 | 5 ml. in 10 minutes |
| *Cross-linked Grafted Starch | 0.4 | 0.8 | 1.1 | 1.4 | 1.7 | 1.9 | 2.1 | 2.5 | 0 at 30 minutes |
| *Fluffed Wood Pulp | 0.7 | 2.1 | 3.4 | 4.0 | 4.5 | 4.7 | 4.9 | 5.1 | 5 ml. in 12 seconds |
| 7C | 1.0 | 4.2 | 6.3 | 6.9 | 7.2 | 7.3 | 7.3 | — | 5 ml. in 18 seconds |
| *Cross-linked Grafted Guar Gum | 0.3 | 0.5 | 0.8 | 1.2 | 1.5 | 1.9 | 2.3 | 3.3 | 0 at 30 minutes |
| *Grade 85 Chemical Cotton | 0.8 | 2.8 | 3.7 | 4.3 | 4.5 | 4.5 | 4.5 | — | 5 ml. in 12 seconds |
| 7D | 0.6 | 2.6 | 4.3 | 5.7 | 6.6 | 7.2 | 7.5 | 7.9 | 5 ml. in 35 seconds |
| *Cross-linked Acrylamide-Sodium Acrylate Copolymer | 0.4 | 0.7 | 1.0 | 1.2 | 1.3 | 1.4 | 1.6 | 1.7 | 0 at 30 minutes |
| *Grade 85 Chemical Cotton | 0.8 | 2.8 | 3.7 | 4.3 | 4.5 | 4.5 | 4.5 | — | 5 ml. in 12 seconds |

[1]Absorption of 1% NaCl solution (ml./g. of sample) at various times in minutes
[2]Rate of climb of 1% NaCl solution in syringe
[3]Sample gels and plugs filter
*Controls As shown by the CAP test and Syringe test data in Table VII, coated fiber samples prepared according to the procedures in Examples 7A, 7B, 7C and 7D were superior to their corresponding fine particle superabsorbent in absorption capacity, initial rate of absorption and wicking action.

EXAMPLE 8

To a Waring Blendor jar containing 400 ml. of acetone was added 6 g. of Grade 85 Chemical Cotton and 4 g. of partial free acid CMC to form a blend containing 40% partial free acid CMC in which the chemical cotton fibers were not coated. Stirring was continued at low speed for 2 minutes, following which excess acetone was removed and the sample was dried in vacuum at 60° C.

The absorbency of this material was determined via the CAP test. Results of this test, as compared with Example 1G, show that coated fiber containing 40% partial free acid CMC add-on is considerably more effective as an absorbent medium in both initial rate and absorption capacity than is the blend of partial free acid CMC and chemical cotton of the same CMC content. The data are presented graphically in FIG. 1.

EXAMPLE 9

9A

In a Waring Blendor jar containing 400 ml. of acetone was blended 8 g. of a material similar to that of Example 1F containing 50% partial free acid CMC and 2 g. of Grade 85 Chemical Cotton, resulting in a sample having a total partial free acid CMC content of 40 weight percent. Excess acetone was removed and the sample dried in vacuum at 60° C.

9B

Example 9A was repeated using 6 g. of a material similar to that of Example 1F and 4 g. of Grade 85 Chemical Cotton, resulting in a sample having a total partial free acid CMC content of 30 weight percent.

9C

Example 8 was repeated using 7 g. of Grade 85 Chemical Cotton and 3 g. of partial free acid CMC to form a blend containing 30 weight percent of partial free acid CMC and containing no coated fibers.

Absorption characteristics of these materials were determined using the CAP test. The comparison of these data, along with data of Example 8, is presented graphically in FIG. 2. The data in this graph show the improved absorbency (faster initial rate and higher absorption capacity) exhibited by a blend of the coated fiber and chemical cotton as compared to a blend of partial free acid CMC with uncoated chemical cotton in which the total CMC content is the same.

EXAMPLE 10

10A

An aqueous slurry was prepared as described in Example 7D. After the required stirring, the slurry was transferred to an aluminum pan, and the water removed by drying in vacuo at 60° C. It required a total of 10 hours to dry to constant weight. The sample formed a dense, brittle mat on drying, in contrast to the soft, fluffy material prepared by the Example 7D procedure where acetone was used to remove the water prior to drying from the acetone-wet state.

The CAP test data in Table VIII show that drying from the acetone-wet state as in Example 7D is much superior to drying from the water-wet state as in this example, leading to a faster initial rate of absorption and a higher absorption capacity.

10B

An aqueous slurry was prepared as described for Example 1F. After the required stirring, the slurry was placed in an aluminum pan, and the water removed by drying at 100° C. in an airdraft oven. It required 7 hours to dry to constant weight. This sample, though not as dense and brittle as 10A, was brittle and hard. In contrast, the material of Example 1D, dried from the acetone-wet state, was soft and fluffy.

Again, the CAP test data in Table VIII show that superior absorption properties result by drying from the acetone-wet state rather than drying from the water-wet state.

TABLE VIII

| | Absorption/Time Interval | | | | | | | | | | |
|---|---|---|---|---|---|---|---|---|---|---|---|
| Example No. | 1 | 3 | 5 | 10 | 15 | 20 | 25 | 30 | 35 | 40 | 45 |
| 10A | 0.1 | 0.3 | 0.5 | 0.7 | 1.1 | 1.5 | 1.8 | 2.0 | 2.1 | 2.3 | 2.5 |
| 7D | 0.6 | 1.7 | 2.6 | 4.3 | 5.7 | 6.6 | 7.2 | 7.5 | 7.7 | 7.9 | 7.9 |
| 10B | 0.4 | 1.3 | 2.1 | 3.7 | 4.7 | 5.3 | 5.7 | 5.9 | 6.0 | 6.2 | 6.2 |
| 1F | 1.5 | 4.0 | 6.1 | 8.4 | 8.9 | 9.1 | 9.1 | 9.1 | — | — | — |

What I claim and desire to protect by letters patent is:

1. Cellulosic fibers having a rapid rate of absorption and a high absorption capacity for water or aqueous salt solutions comprising a long fiber cellulose having on its surfaces a coating of water-insoluble, water-absorbent polymer in an amount equal to 15 to 90% by weight based on the total weight of the coated fiber and being in the form of separate and discrete fibers, said coated fibers having a higher absorption capacity than the uncoated long fiber cellulose.

2. A cellulosic fiber having a rapid rate of absorption and a high absorption capacity for water or aqueous salt solutions which comprises a long fiber cellulose in the form of separate and discrete fibers having on their surfaces a coating of water-insoluble, water-absorbent polymer in an amount equal to 15 to 90% by weight based on the total weight of the coated fiber, said water-absorbent polymer being selected from the class consisting of cross-linked sodium carboxymethyl cellulose, cross-linked partial free acid carboxymethyl cellulose, cross-linked hydroxyethyl cellulose, cross-linked cellulose-acrylamide-acrylic acid copolymers and cross-linked acrylamide-acrylic acid copolymer, said coated fiber having a higher absorption capacity than the uncoated long fiber cellulose.

3. A product according to claim 2 wherein the modified cellulose is an epihalohydrin cross-linked carboxymethylcellulose.

4. A product according to claim 2 wherein the modified cellulose is partial free acid carboxymethylcellulose.

5. The product according to claim 2 wherein the long fiber cellulose is selected from the class consisting of wood pulp, chemical cotton and cotton staple.

6. The product according to claim 2 wherein the long fiber cellulose is rayon staple fiber.

7. A cellulosic fiber having a rapid rate of absorption and a high absorption capacity for water or aqueous salt solutions which comprises a separate and discrete staple cotton fiber having on its surfaces a coating comprising about 40 to 90% by weight of partial free acid carboxymethyl cellulose based on the total weight of the coated fibers, said coated fiber having a higher absorption capacity than the uncoated staple cotton.

8. A cellulosic fiber having a rapid rate of absorption and a high absorption capacity for water or aqueous salt solutions which comprises a separate and discrete wood pulp fiber having on its surfaces a coating comprising about 40 to 90% by weight of partial free acid carboxymethyl cellulose based on the total weight of the coated fiber, said coated fiber having a higher absorption capacity than the uncoated wood pulp.

9. A cellulosic fiber having a rapid rate of absorption and a high absorption capacity for water or aqueous salt solutions which comprises a separate and discrete chemical cotton fiber having on its surfaces a coating comprising about 40 to 90% by weight of partial free acid carboxymethyl cellulose based on the total weight of the coated fiber, said coated fiber having a higher absorption capacity than the uncoated chemical cotton.

10. A blend of an untreated long fiber cellulose and a long fiber cellulose having a higher absorption capacity than said untreated long fiber cellulose comprised of separate and discrete fibers coated with a water-insoluble, water-absorbent polymer and having a ratio of coated to uncoated fibers such that the total concentration of water-insoluble, water-absorbent polymer in the blend is about 15 to 80%.

11. A method of preparing cellulosic fibers having a rapid rate of absorption and a high capacity for water or aqueous salt solutions which comprises preparing an aqueous suspension of separate and discrete long fiber cellulose fibers containing a water-insoluble, water-absorbent polymer, stirring the suspension until the water-insoluble, water-absorbent polymer forms an aqueous gel, adding to the suspension an inert water-miscible diluent in which the polymer is neither soluble nor swellable to precipitate the polymer onto the surface of the long fiber cellulose and thereafter dehydrating the coated fibers by contacting them with a water-miscible diluent in which the polymer is neither soluble nor swellable, removing the diluent and recovering separate and discrete long fiber cellulose fibers therefrom.

12. The process of claim 11 wherein the long fiber cellulose is selected from the group consisting of wood pulp, chemical cotton and cotton staple.

13. The process of claim 12 wherein the water-insoluble, water-absorbent polymer is a modified polysaccharide.

14. The process of claim 13 wherein the polysaccharide is cellulose.

15. The process of claim 14 wherein the modified cellulose is selected from the class consisting of epichlorohydrin cross-linked carboxymethylcellulose and partial free acid carboxymethylcellulose.

16. The process of claim 12 wherein the aqueous suspension is prepared in water containing up to about 50% acetone.

17. The process according to claim 12 wherein the water-miscible diluent employed to precipitate the polymer onto the cellulose fiber is acetone and water-miscible diluent employed to dehydrate the coated fibers is also acetone.

* * * * *